US005556579A

United States Patent [19]

Newman

[11] Patent Number: 5,556,579

[45] Date of Patent: Sep. 17, 1996

[54] TOBACCO JAR COVER HAVING HUMIDITY CONTROL AND METHOD OF USE

[76] Inventor: Mark R. Newman, P.O. Box 17009, Tucson, Ariz. 85731

[21] Appl. No.: 506,481

[22] Filed: Jul. 25, 1995

[51] Int. Cl.[6] ..... B01F 3/04

[52] U.S. Cl. ..... 261/99; 312/31.1; 239/59

[58] Field of Search ..... 312/31.1; 261/99; 239/59

[56] References Cited

U.S. PATENT DOCUMENTS

| | | | |
|---|---|---|---|
| 1,059,693 | 4/1913 | Woods . | |
| 1,534,339 | 4/1925 | Perry . | |
| 1,655,248 | 1/1928 | Sharp . | |
| 1,938,384 | 12/1933 | Hauch . | |
| 1,999,554 | 4/1935 | Zucker . | |
| 2,202,796 | 5/1940 | Hermani . | |
| 2,522,952 | 9/1950 | Krohn | 312/31.1 |
| 2,546,599 | 3/1951 | Hicks | 312/31.1 |
| 2,680,048 | 6/1954 | McDonald . | |
| 2,819,135 | 1/1958 | Shapiro . | |
| 3,081,137 | 3/1963 | Kolokythas | 312/31.1 |
| 3,336,093 | 8/1967 | Phelps . | |
| 3,431,038 | 3/1969 | Berliner | 312/31 |
| 4,008,930 | 2/1977 | Swainson . | |
| 4,428,892 | 1/1984 | Berliner | 261/99 |

*Primary Examiner*—Tim R. Miles
*Attorney, Agent, or Firm*—Victor Flores

[57] ABSTRACT

A cover for containers, especially glass jars, that are used to store and keep fresh consumable merchandise, such as tobacco, coffee, or tea. The cover includes structure for receiving a cover mount member that facilitates attachment of a mechanical interface structure that carries and supports a humidity control member in a manner that further facilitates gravitational capillary action of the water in the humidistat. In kit form, a cover mount member is provided with structure that facilitates attachment to a container's cover member and also with mounting structure for fitting a mechanical interface, such as a grommet, that receives the inlet end of a humidistat. The cover mount member and humidity control member are detachable from the cover member for filling the humidity control member with water. The humidity control valve at the distal end of the humidity control member is adjustable for delivering the desired humidity according to the dryness of the product contained in the container.

6 Claims, 1 Drawing Sheet

TOBACCO JAR COVER HAVING HUMIDITY CONTROL AND METHOD OF USE

FIELD OF THE INVENTION

This invention relates to covers for containers. More particularly, the present invention relates to covers for containers, also referred to as jars, that are used to store fresh consumable merchandise, such as tobacco, coffee, or tea. Even more particularly, the present invention relates to a method of providing a cover for containers that facilitates keeping consumable merchandise fresh.

DESCRIPTION OF THE PRIOR ART

The field of humistats for containers, such as jars for storing a staple product (coffee, tea, tobacco, etc.) has resulted in several patented container structures. Exemplary of the prior art patents in the field are the following:

| U.S. Pat. No. | Inventor | Date of Issue |
|---|---|---|
| 1,059,693 | WOODS | APR. 22, 1913 |
| 1,534,339 | PERRY | APR. 21, 1922 |
| 1,655,24e | SHARP | JAN. 03, 1924 |
| 1,938,384 | HAUCH | DEC. 05, 1931 |
| 1,999,554 | ZUCKER | APR 30, 1935 |
| 2,202,796 | HERMANI | MAY 28, 1940 |
| 2,680,048 | McDONALD | JUN. 01, 1950 |
| 2,819,135 | SHAPIRO | JAN. 07, 1958 |
| 3,336,093 | PHELPS | AUG. 15, 1967 |
| 4,008,930 | SWAINSON | FEB. 22, 1977 |

In particular: U.S. Pat. No. 2,819,135 teaches a cover with an opening for a humidifier member. U.S. Pat. No. 2,202,796 teaches a jar cover in which a moistening device is contained. U.S. Pat. No. 1,999,554 teaches a humidor useable for tobacco containers, including a cover having a container for a moistening agent and passages that function as a valve for controlling the moisture. U.S. Pat. No. 3,336,093 also teaches a humidor including a cover and a container having apertures so that a capillary-action liner fitted in the container will allow water vapors to vaporize through the apertures to moisten the tobacco. U.S. Pat. No. 4,008,930 teaches humidor improvement whereby a water spray can be effected. U.S. Pat. No. 2,680,048 teaches a humidor wherein, preferably in a cover, a water containing chamber member is formed for receiving an absorbent material for regulating the passage of moisture into the humidor. U.S. Pat. No. 1,938,384 teaches a cover with a container for receiving a moistening element surrounded by a valving member for controlling the moisture. U.S. Pat. No. 1,059,693 teaches a cigar box with a humidor in the form of a tank on the lid of the box, including an arrangement of absorbent pads and wicks that control the moisture. U.S. Pat. Nos. 1,655,248 and 1,534,339 teach dehydrating devices formed in the lids of jars.

Discrete humidistat devices known are taught in U.S. Pat. Nos. 3,431,038 and 4,428,892. These humidistat devices comprise structure that only defines the humidistat aspect and do not teach structure to effect mounting of the humidistat to a container.

The above prior art fails to provide an attachable humidistat/cover structure that can readily fit and/or retrofit a container opening and provide an enhanced container that has humidity control. The above prior art fails to provide a humidistat/cover structure that can readily fit and/or retrofit a cover for a container opening and provide a container having a humidity control.

Therefore, a need is seen to exist for a humidity control cover apparatus that can readily fit an existing container cover and provide the container with humidity control capability.

SUMMARY OF THE INVENTION

Accordingly, the primary object of the present invention is to provide a humidity control kit apparatus that can readily fit an existing container cover and provide the container with humidity control capability.

A related object of the present invention is to provide a humidity control cover apparatus that can readily fit an existing container and provide the container with humidity control capability.

The foregoing objects are accomplished by providing a cover member having structure for receiving a cover mount member that facilitates a mechanical interface structure that receives and supports a humidity control member in a manner that facilitates gravitational capillary action of the water in the humidistat. In kit form, a cover mount member is provided with structure that facilitates attachment to a container's cover member and also with mounting structure for fitting a mechanical interface, such as a grommet, that receives the inlet end of a humidistat. The cover mount member and humidity control member are detachable from the cover member for filling the humidity control member with water. The humidity control valve at the distal end of the humidity control member is adjustable for delivering the desired humidity according to the dryness of the product contained in the container.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT

Figure 1:
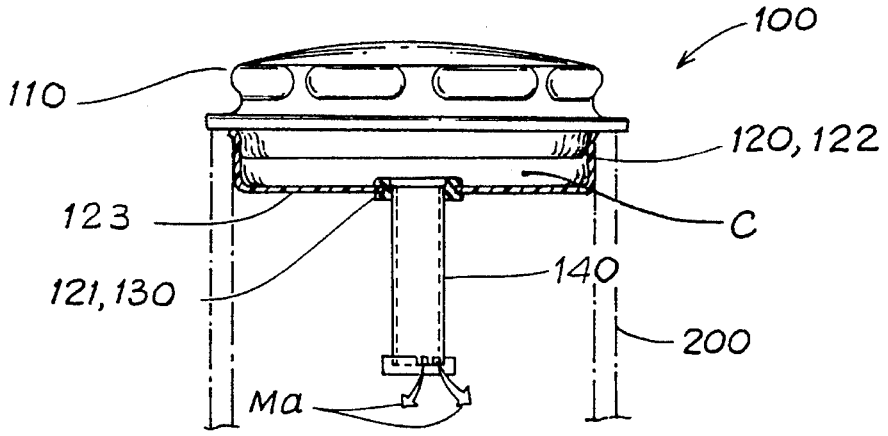
FIG. 1 illustrates a cover apparatus for containers adapted with a humidity control device in accordance with the present invention.

The present invention is directed to the utilization of discrete humidistat devices such as those taught by U.S. Pat. Nos. 3,431,038 and 4,428,892. These discrete devices require a support structure which suspend the humidistat to initiate the controlled flow of moist air MA into a container. In this respect, FIG. 1 illustrates a humidity control cover apparatus 100 including a cover member 110, with a cover mount member 120 and a suspended humidity control member 140 attached in accordance with the present invention for delivering moist air MA into a container utilizing the apparatus.

Cover member 110 is designed to conform to a circular opening on a container 200. However, the opening on a target container may be another geometric shape, such as rectangular, in which case the cover 110 and cover mount 120 would be designed to conform to the geometric shape of the target container. The circular shape shown in the drawings is by example only. The present invention may be practiced in kit form for after market retrofit of containers without any humidity control capability, or may be practiced by direct sale of containers with a cover having humidity control, or may additionally be practiced by direct sale of container covers with the humidity control system attached. For all applications the particular container cover geometry and associated dimensions must be determined in order to form the cover mount member 120 to fit a target container opening.

Figure 2:
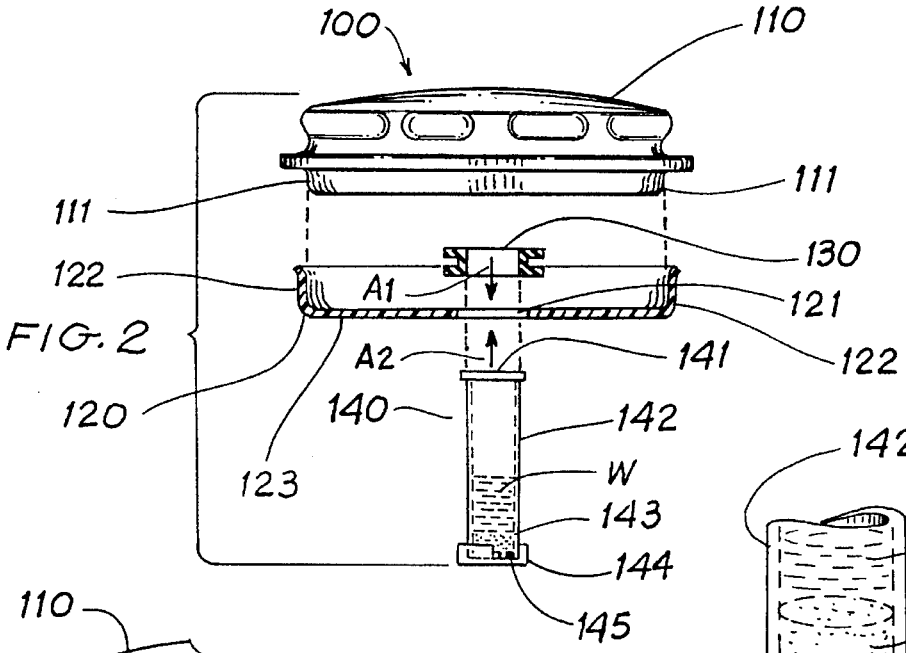
FIG. 2 illustrates an assembly view of components that form the cover apparatus of the present invention.
Figure 3:
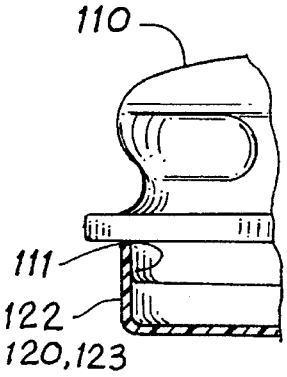
FIG. 3 illustrates a seal characteristic of the cover apparatus.
Figure 4:
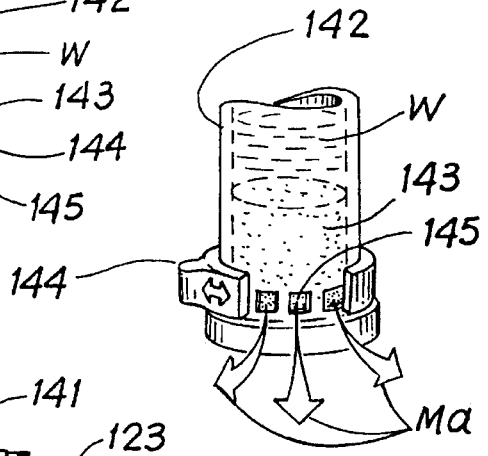
FIG. 4 illustrates a diagram of the humidity control device and the basic fluid action performed to provide moist air into a container utilizing the cover apparatus of the present invention.
Figure 5:
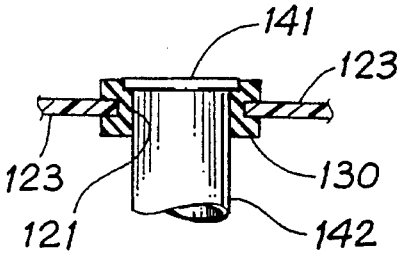
FIG. 5 illustrates a grommet attached to both the humidity control device and to the cover mount member for forming the mechanical interface structure of the preferred embodiment of the present invention.

As shown in FIG. 2, cover member 110 is preferably formed, or provided if utilizing an existing cover, having a depending flange 111 that ordinarily provides a sealing function. The flange 111 for the present invention's purposes, also serves as an attachment means for cover mount member 120. Cover mount member 120 is preferably formed from a substantially thin soft pliable plastic material and includes a lip 122 that facilitates a detachably secured engagement onto flange 111. The thickness of lip 122 is designed to not interfere with the sealing function of the cover 110, see generally FIG. 3. The pliability of the material for cover mount member 120 is believed to actually encourage a better seal for cover 110. Lip 122 upon being secured onto flange 111 forms a chamber C beneath the body of cover 110. Chamber C provides space for flexing of cover mount member 120 during mounting and detachment from flange 111. Cover mount member 120 has the primary function of carrying a humidistat 140. To accomplish this task, cover mount member 120 is formed having a bottom 123 on which an opening 121 is formed for attachment of a mechanical interface member 130 which carries humidistat 140. The mechanical interface 130 is preferably a grommet that attaches about the material of opening 121, as indicated by arrow A1 in FIG. 2. Grommet 130 includes an opening 131 for securably receiving a fill-end portion 141 of humidistat 140, as indicated by arrow A2 in FIG. 2, see also FIG. 5. As shown in FIG. 4 humidistat 140 preferably comprises a cylindrical body 142 for containing water W and an absorbent material 143 and an evaporation control element 144 for regulating the number of passages 145 that allow moist air MA into a container utilizing the apparatus.

Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus.

I claim:

1. A humidity control cover apparatus for containers, said apparatus comprising:

a cover member, said cover member having a peripheral flange portion for engaging an opening of a container;

a cover mount member, said cover mount member being provided with peripheral structure for engaging said flange portion;

a humidity control member; and a mechanical interface member, said cover mount member being provided with an opening for mounting said mechanical interface member, and said humidity control member being detachably mounted to said mechanical interface member.

2. A humidity control cover apparatus as described in claim 1, wherein:

said humidity control member comprises a vessel body member, a cap member, a moisture absorbing member and an evaporation valve member; and said mechanical interface member being a grommet member formed from a resilient material having an outer peripheral structure designed to engage said opening on said cover mount member and having an eyelet portion for receiving said vessel body member and supporting said humidity control member.

3. A method of retrofitting a container with a humidity control apparatus, said method comprising the steps of:

(a) providing a container having an opening;

(b) providing a humidity control cover apparatus for said container, said apparatus comprising:

a cover member, said cover member having a peripheral flange portion for engaging said opening of said container;

a cover mount member, said cover mount member being provided with peripheral structure for engaging said flange portion;

a humidity control member; and a mechanical interface member, said cover mount member being provided with an opening for mounting said mechanical interface member, and said humidity control member being detachably mounted to said mechanical interface member;

(c) mounting said mechanical interface member to said cover mount member;

(d) mounting said humidity control member to said mechanical interface member;

(e) filling and covering said humidity control member with an evaportable fluid;

(f) mounting said cover member with said humidity control member, as described in steps (c), (d) and (e), to said peripheral flange portion; and (f) covering said container with said cover member to effect said retrofitting task.

4. A container apparatus having humidity control, said apparatus comprising:

a container having an opening;

a cover member, said cover member having a peripheral flange portion for engaging said opening of said container;

a cover mount member, said cover mount member being provided with peripheral structure for engaging said flange portion;

a humidity control member; and a mechanical interface member, said cover mount member having an opening for mounting said mechanical interface member, and said humidity control member being detachably mounted to said mechanical interface member.

5. A humidity control kit apparatus for adapting containers with humidity control, said containers having an opening and a cover member, said cover member having a peripheral flange portion for engaging said opening of said container, said apparatus comprising:

a cover mount member, said cover mount member having peripheral structure for engaging said flange portion;

a humidity control member; and a mechanical interface member, said cover mount member being provided with an opening for mounting said mechanical interface member, and said humidity control member being detachably mounted to said mechanical interface member.

6. A humidity control kit apparatus as described in claim 5, wherein:

said humidity control member comprises a vessel body member, a cap member, a moisture absorbing member and an evaporation valve member; and said mechanical interface member being a grommet member formed from a resilient material having an outer peripheral structure designed to engage said opening on said cover mount member and having an eyelet portion for receiving said vessel body member and supporting said humidity control member.

* * * * *